US005768966A

United States Patent [19]

Duginske

[11] Patent Number: 5,768,966

[45] Date of Patent: Jun. 23, 1998

[54] WOODWORKING MACHINERY JIG AND FIXTURE SYSTEM

[76] Inventor: Mark A. Duginske, 1010 First Ave., North Wausau, Wis. 54401

[21] Appl. No.: 754,438

[22] Filed: Nov. 21, 1996

Related U.S. Application Data

[63] Continuation-in-part of Ser. No. 278,369, Jul. 21, 1994, Pat. No. 5,617,909, which is a continuation-in-part of Ser. No. 944,867, Sep. 14, 1992, Pat. No. 5,337,641.

[51] Int. Cl.[6] ..... B27B 27/00; B27B 31/00

[52] U.S. Cl. ..... 83/468.7; 83/468; 83/468.3; 144/253.1; 269/303; 269/315

[58] Field of Search ..... 144/253.1, 253.5; 83/435.1, 467.1, 468, 468.7, 477.2, 468.3; 269/303, 304, 306, 315

[56] References Cited

U.S. PATENT DOCUMENTS

| | | | |
|---|---|---|---|
| 2,787,301 | 4/1957 | Anderson . | |
| 3,827,686 | 8/1974 | Storkh | 269/315 |
| 3,994,484 | 11/1976 | Schorr | 269/315 |
| 4,256,000 | 3/1981 | Seidel | 83/468.2 |
| 4,693,158 | 9/1987 | Price | 269/303 |
| 4,817,693 | 4/1989 | Schuler | 144/359 |
| 5,018,562 | 5/1991 | Adams | 269/303 |
| 5,038,486 | 8/1991 | Ducate, Sr. | 33/430 |
| 5,063,983 | 11/1991 | Barry | 144/371 |
| 5,443,554 | 8/1995 | Robert | 269/315 |
| 5,553,644 | 9/1996 | Adams | 144/253.1 |

OTHER PUBLICATIONS

Applicant's Exhibit No. 1, front and rear cover pages and pp. 72–85 and 166 of "The 1992 Garrett Wade Tool Catalog" of Garrett Wade Company, Inc. 161 Avenue of the Americas, New York, New York 10013.

Applicant's Exhibit No. 2, admitted prior art, page entitled "Vises & Clamps".

Applicant's Exhibit No. 3, admitted prior art, page entitled "Joiner's Edge High Precision T–Slot Extrusion Modular 3–In–1 Woodworking System" of Wood Werks Supply, Inc.

Applicant's Exhibit No. 4, admitted prior art, page entitled "Farris Right Angle Gauge Lets You Make Perfect Miters Of Any Angle".

Applicant's Exhibit No. 5, admitted prior art, page entitled "Power Saws".

Applicants's Exhibit No. 6, Holiday 1994 WoodsmithShop Catalog of WoodsmithShop, 2200 Grand Avenue, Des Moine, Iowa 50312, cover and p. 14 showing adjustable miter fence, dated 1994.

Applicants'Exhibit No. 7, 2–page flyer entitled "Vega Performance Miter Gage" of Vega Enterprises Inc., RR 3, Box 193, Decatur, Illinois 62526, dated Aug. 1994.

*Primary Examiner*—W. Donald Bray
*Attorney, Agent, or Firm*—Quarles & Brady

[57] ABSTRACT

A woodworking machinery jig and fixture system includes an L-shaped track which can be attached to a separate wood fence, a miter head, an auxiliary table or other workpiece support of woodworking machinery such as a table saw, a band saw, radial arm saw, miter saw, a drill press or a router table. Two T-slots are formed in the top of the track, two are formed in the front, and one is formed in the back. A flip stop can be adjustably mounted in either of the two top T-slots, a wood fence can be secured in the front T-slots and the rear T-slot can be used to mount the track to a miter head, fence of a miter saw, or other work guide. Two sections of track can be connected with a connector set, and a lower end cap is used to support the workpiece next to the cutting tool. A miter guide with a 360° adjustable head can be used to mount a section of track and the track to mount stops for clamping a workpiece between them for cutting tapers. A wood fence can be used to extend the track, with a stop adjustably mounted on the top of the wood fence. A guideway for the miter guide has a concave bottom wall which adjustably flexes to tighten the guideway around a miter guide bar.

24 Claims, 16 Drawing Sheets

WOODWORKING MACHINERY JIG AND FIXTURE SYSTEM

This application is a continuation in part of U.S. patent application Ser. No. 08/278,369 filed Jul. 21, 1994, pending, which is a continuation in part of U.S. patent application Ser. No. 07/944,867 filed Sep. 14 1992, which issued as U.S. Pat. No. 5,337,641 on Aug. 16, 1994.

FIELD OF THE INVENTION

This invention relates to jigs and fixtures for positioning, aligning, guiding and/or holding a workpiece on wood and metal working machinery during a cutting or shaping operation.

BACKGROUND OF THE INVENTION

U.S. Pat. No. 5,337,641, the disclosure of which is hereby incorporated by reference, discloses improved jigs and fixtures for positioning, aligning, guiding and/or holding a workpiece as it is worked, for example as it is cut, drilled or routed. While the jigs and fixtures disclosed in U.S. Pat. No. 5,337,641 represent a significant advance in the art, room still exists for improvement, particularly in the following respects:

- The wooden auxiliary fence can warp even when it is attached to the track extrusion;
- The fence requires exact machining of the groove to mount a ruler;
- It takes clamps and considerable care to hold the track to the board as it is screwed in place;
- It requires two pieces of track attached to the top and back of the board for many applications which makes the fence bulky and expensive. See FIG. 14A of U.S. Pat. No. 5,337,641;
- When the wood fence is moved next to the blade for a new cut on the table or radial saw, the ruler has to be repositioned, which is tedious;
- Because the wood is screwed to the extrusion, it is not possible to move the two pieces of wood closer together for a zero clearance fence which would be ideal for a miter saw or a router table fence; and
- It is hard to extend the track for longer cuts. Although Ducate U.S. Pat. No. 5,038,486 allows longer lengths to be cut with the stop 120, no provision is made for cutting lengths between the stop 120 and the end of the outer rail 112. Also, no provision is made in U.S. Pat. No. 5,038,486 or Vega for using a wood fence with zero clearance between it and the blade, for supporting the workpiece at the edge of the kerf.
- There is no mechanism for attaching pieces of track together at an angle which is ideal for doing production cutting of angle frame pieces on the tablesaw.

U.S. Pat. No. 5,337,641 also discloses miter guides, which may have fixed or variable angle heads. Miter guides with variable angle heads typically have been of two different designs. One uses an adjustable set screw with a flip up stop for frequently used angles such as 90° and 45°. These are not accurate because the setting is dependent on the amount of pressure against the stop. A second type has a pin which is usually tapered. The pin is pressed into a hole or groove in the head. If the pin is bent, all the settings are off.

Miter Guides usually are limited to a quarter of a full arc or 90 degrees of rotation. Although this design allows for angled crosscuts, it does not allow for angles of more than 45 degrees as would be required for cutting tapers such as chair and table legs.

Mitered corners on moldings, such as a picture frame, require cutting the ends of the mouldings with two setups. All of the cuts on one end of the moulding are typically first made with the miter guide in one miter slot, on one side of the table saw blade. Then, the cuts on the opposite ends of the moulding pieces are made with the miter guide in the other slot on the other side of the blade. This requires resetting the miter head angle and fence for use in each miter slot, which is time consuming.

To expedite cutting moulding angles on each end, it is known in the prior art to make a large wood auxiliary platform that has a runner that fits in the miter slot. Two angled fences that support the moulding at the appropriate angles are secured to each side of the wood platform, on opposite sides of the blade. The advantage is that both ends of the moulding can be cut one after the other. For accurate cuts, the platform must be made to a very high degree of accuracy. These platforms are very bulky and tedious to make.

In recent years, the router table and the miter saw have become popular. Each requires a fence which can be made of wood or metal. Commercially available fences are made of metal, usually extruded aluminum, and have the advantage of being straight, light in weight and compact. There has been no easy way, however, to attach a wood fence and still be able to use the advantages of metal fence accessories, such as flip stops.

The track and wood combination of U.S. Pat. No. 5,337,641 can be used for a router or miter saw fence (See, for example, FIG. 14A of U.S. Pat. No. 5,337,641, but if so is limited since the wood fence is screwed to the track. Because the wood is screwed to the fence, it does not easily allow zero clearance with the bit or cutter. Therefore, the two wood halves can not be easily repositioned closer together, as is ideal for the router table and the miter saw. There is no simple mechanism for adding an auxiliary wood fence to the front of the router table fence to create two offset sides, which is desirable for jointing operations and full profile cuts with a router bit.

Another problem arises if the ruler is attached to the movable wood fence because as it moves closer to the blade or cutter (as the fence is moved), the ruler loses its accuracy and has to be carefully readjusted, if that option is available.

SUMMARY OF THE INVENTION

The invention provides an improved system for making jigs and/or fixtures in a woodworking shop, and which can be used to enhance wood and metal fences and wood tables of woodworking machinery such as table saws, band saws, radial arm saws, miter saws, drill presses and router tables. In a woodworking machinery jig and fixture system of the invention, a section of track along which jigs and fixtures may be adjustably secured has a generally L-shaped cross-sectional shape, having a first leg with a front side and a rear side and a second leg connected to one end of the first leg at a right angle. The second leg extends rearwardly from the first leg and has a top side and a bottom side, and the track has a longitudinal T-slot on its rear side and a longitudinal T-slot on its top. The rear T-slot can be used to adjustably secure the track to a work guide, and the top T-slot can be used to adjustably secure stops or other jigs and fixtures.

In an especially useful form, a second longitudinal T-slot is formed in the top side of the track, and preferably two T-slots are formed in the front of the track. The two slots on front can be used to attach a wood auxiliary fence to the front, and the second T-slot on top permits mounting a stop even with the auxiliary fence in place.

In an especially useful form, a miter head to which the track is secured is adjustable through at least plus or minus 90°, and preferably plus or minus 180° from a 0° position. Stops are secured to the track which clamp a workpiece between them to hold the workpiece against the front surface of the first leg. This arrangement is especially suited to cutting long shallow angles using the miter head.

In another preferred aspect, an end cap is secured to the first leg of the track at an end of the first leg for supporting a workpiece closely adjacent to the cutting tool, to reduce tear-out at the back of the workpiece when the blade breaks through. The end cap is preferably reduced in height, so that it fits easily under the blade guard.

A track of the invention is very versatile in that two of the tracks can be connected end to end or they can be connected at a certain angle by an angle bracket and with a space between them. Long lengths of track can therefore be provided to cut long workpieces, or, when using angle connectors, both ends of frame pieces can be cut without changing the table saw setup.

In another aspect, a track of the invention can be extended by a wood fence which is secured to the track against the front face of the first leg and a stop is adjustably positionable along a top edge of the wood fence. A track of the invention can also be secured to a metal fence of a woodworking machine, for example, a miter saw.

In another preferred aspect, the track is secured to a miter head which is secured to a miter bar, and the miter bar is slidable in an elongated longitudinal flexible channel having a generally U-shaped lateral cross-section with a bottom wall, two laterally spaced apart side walls and an open top. The side walls extend toward the top along opposite edges of the bottom wall and a lower surface of the bottom wall is raised in a lateral center thereof relative to side edges of the lower surface. The bottom wall has at least one hole therethrough for insertion of a threaded fastener to secure the guideway to a woodworking machinery support so that as the fastener is tightened, the bottom wall is flexed downwardly and reduces a lateral spacing between the side walls. Preferably, the bottom wall is convex toward the top in lateral cross-section, the inner surface of at least one of said side walls is arcuate in cross-section from top to bottom, a longitudinal notch is formed in the exterior surface of the bottom wall adjacent to one of the side walls and at least a portion of the interior surface of at least one of the side walls is flat.

Other objects and advantages of the invention will be apparent from the following detailed description of the preferred embodiments and from the drawings.

DETAILED DESCRIPTION OF THE PREFERRED EMBODIMENTS

Figure 1:
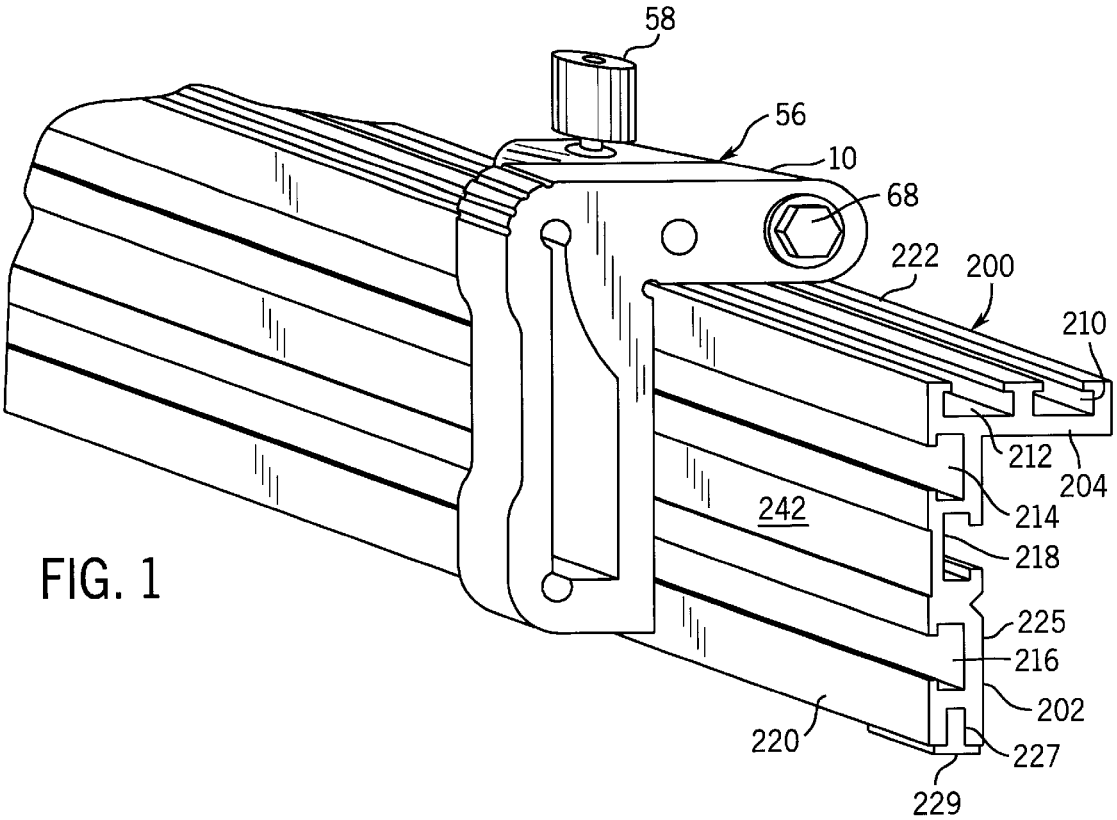
FIG. 1 is a perspective view of a woodworking jig and fixture system incorporating a track of the invention.

FIG. 1 illustrates a track 200 of the invention, shown together with a flip stop assembly 56 with a flip stop 10 which is pivotable about the axis of bolt 68, as disclosed in U.S. Pat. No. 5,337,641 and U.S. patent application Ser. No. 08/278,369 filed Jul. 21, 1994, the entire disclosures of both of which are hereby incorporated by reference. The flip stop 10 is slidable along the length of the track by loosening knob 58 to loosen the head of bolt 84 which slides in one of the T-shaped slots of the track 200.

The track 200 differs from the track described in U.S. Pat. No. 5,337,641 because it is L-shaped, having a first leg 202 at a right angle to a second leg 204, and has a particular arrangement of 5 T-slots 210, 212, 214, 216 and 218. The track 200 is designed to provide a woodworker with maximum flexibility when using woodworking equipment. The L-shape provides maximum strength in a space saving profile; no part of the shape is more than ½" thick. The track 200 is preferably an extruded aluminum alloy.

The 5 T-slots are arranged with the two T-slots 214 and 216 on the front 220 of the first leg 202 and the two T-slots 210 and 212 on the top 222 of the second leg 204. The T-slot 218 on the rear 225 of the first leg 202 is used for attaching the track 200 to a woodworking machine or accessory. The middle of the T-slot 218 is 1½ inches from the bottom of the L-shaped fence since practically all of the attaching holes in various machines are drilled 1½ inches from the table. A groove 227 may be provided in the bottom into which a plastic bearing 229 may be friction fit, snapped or otherwise secured, for sliding against the table of the machine as the track 200 is moved across the table.

Figure 2:
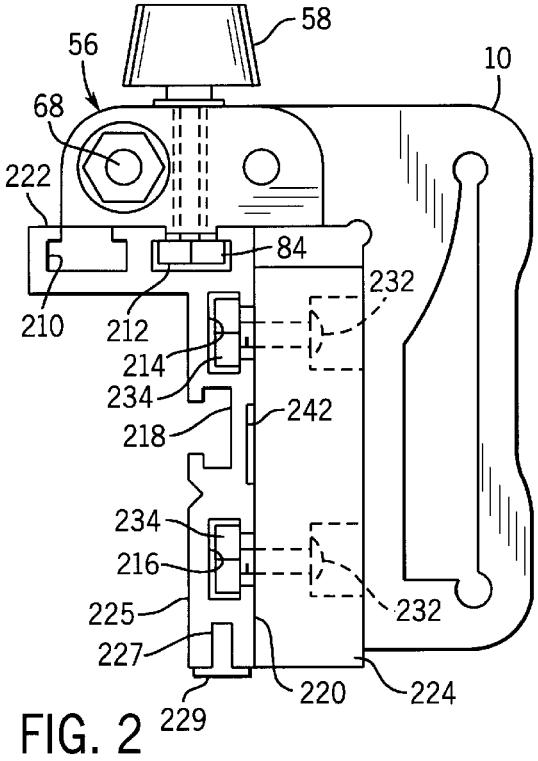
FIG. 2 is an end elevation view of the system of FIG. 1 with an auxiliary wood fence secured to the track.
Figure 5:
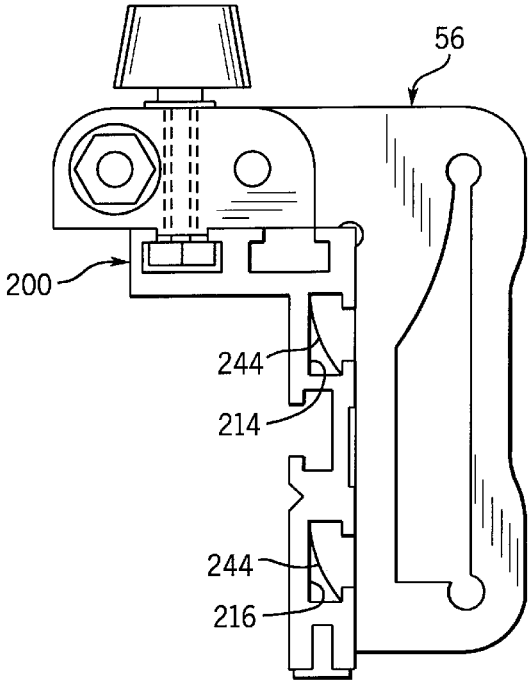
FIG. 5 is a view like FIG. 3, but with rulers installed in the front T-slots of the track.

As shown in FIGS. 2 and 5, a one-piece wood fence 224 (FIG. 2) or a two-piece wood fence 226 (FIG. 5), which includes upper fence 228 and lower fence 230, can easily be attached to the front of the L-shaped track 200. These are attached with screw driver headed bolts 232 which are countersunk in the front of the wood fence. The fence 224, and the pieces 228 and 230 of the fence 226, can be moved laterally relative to the track 200 by loosening the round head bolts 232 with a standard screw driver. The bolts 232 are screwed into jam nuts 234 which are trapped in the T-slots 214, 216 so that tightening the bolts 232 clamps the flanges of the T-slot between the back of the wood fence and the nuts 234. Moving the wood fence 224 or 230 along the track 200 allows contact of the fence with the blade or router bit when making a cut, thereby decreasing the amount of vibration and tearout of the workpiece during the cut, which is called zero clearance. It also allows the operator to know exactly where the cut line is.

Figure 3:
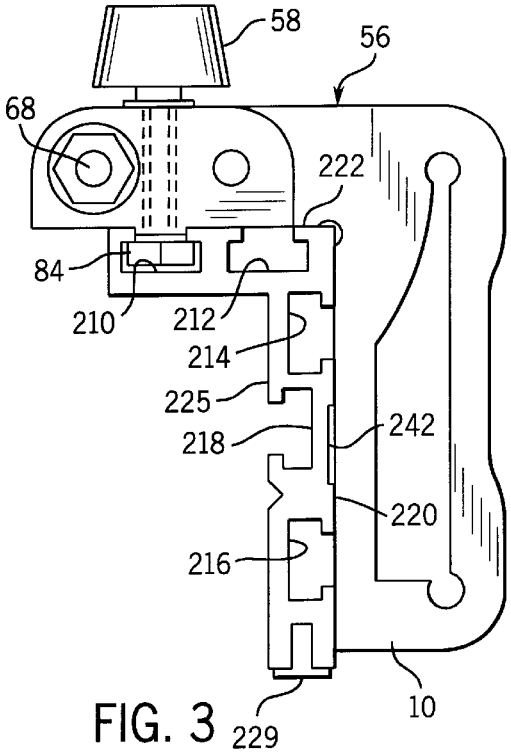
FIG. 3 is an end elevation view of the system of FIG. 1 without an auxiliary fence.
Figure 4:
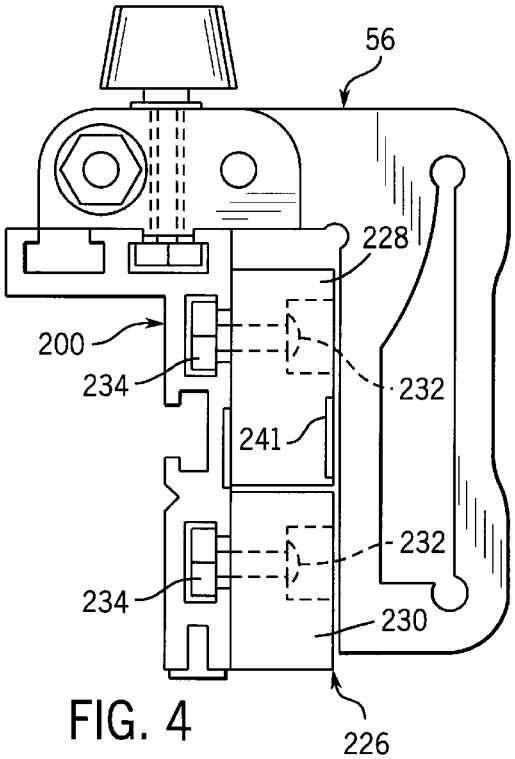
FIG. 4 is a view like FIG. 4, but with a two piece auxiliary wood fence.

There are two ways to use the stop 56. It can be used with or without a wood fence. With the fence is illustrated in FIGS. 2 and 4, and without is illustrated in FIGS. 3 and 5. The forward T-slot 212 holds the stop 56 when a wood auxiliary fence 224 or 226 is attached to the front of the L-shaped track 200 for zero clearance. The rearward slot 210 is used when there is no wood fence.

Figure 6:
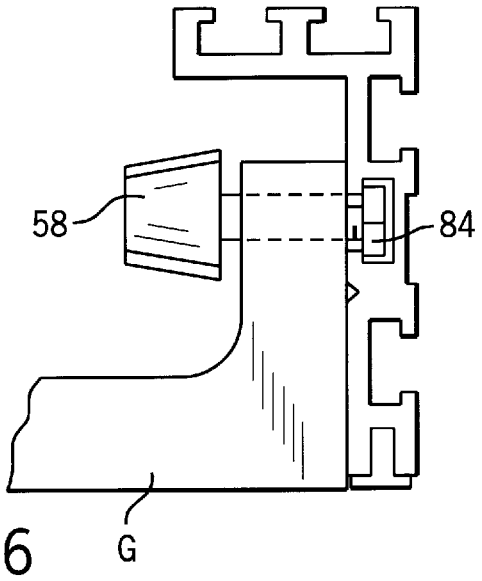
FIG. 6 is an end elevation view of the track of FIG. 1 secured to a miter head.

The wood used for the face of the L-shaped track is preferably ½" thick. It can be made of plywood or solid wood cut and planed down to a ½" dimension. Jam nuts 234 are provided with a slot headed bolt 232 for securing the wood fence to the track 200. The track 200 is easily repositioned and locked in place with a standard screwdriver, with bolts 232 and jam nuts 234, or with knobs 58 and bolts 84 (FIG. 6), in the slot 218. The ⅝" counterbores in the wood fence for the heads of the bolts 232 should be no more than 5/16 of an inch deep. The through hole should be made with a 9/32" drill bit.

There are three options for adding a wood fence to the track 200:

LOW FENCE: The first option is to add only the lower fence 230, which is one inch high. This design has the advantage of easily sliding under the saw blade guard. It also allows the user to easily see a fixed ruler 244 which may be received in T-slot 214 in the track 200 (See FIG. 5).

DOUBLE FENCE: As stated above, the double fence 226 is composed of two pieces of wood 228 and 230 which can be moved independently of each other. The lower piece 230 can be the same as the low fence which easily slides under the table saw guard. A ruler 241 can be attached to the top piece 228 which can be repositioned as required.

HIGH FENCE: The one piece high fence 224 can easily be mounted to the front of the track as illustrated in FIG. 2. This design is particularly useful if the workpiece is resting on its edge which is required for joinery.

There are a number of different options for using a ruler with the track. The depression 242 in the front of the track 200 is designed to receive a standard ½" wide self stick tape ruler, which is visible if only a low fence 230 is used. As mentioned above in the section on the double fence, a ruler 241 can be used with a wood fence, allowing the ruler to be repositioned if desired. The T-slots on the front and the top of the track 200 are sized to accept a ½" replacement measuring tape (See FIG. 5). The replacement tape fits snugly enough so that it will remain secure without any additional locking mechanisms.

One of the advantages of this system is that the ruler is a "direct read", which means that the workpiece end is the reference for the ruler. If a piece of wood is added to the stop to expand the surface area of the stop, it does not change the ruler reading because the ruler is still sighted directly off the end of the workpiece.

Figure 7:
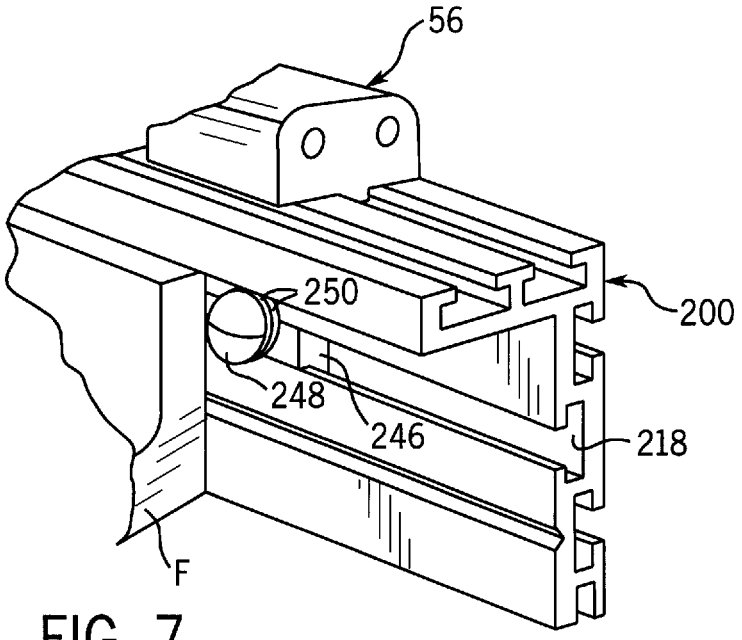
FIG. 7 is a rear perspective view of the track of FIG. 1 secured to a miter saw fence illustrating a stop on the rear of the track.

Referring to FIG. 7, a position stop 246 is provided for easily relocating the track 200 if it is removed from a miter saw fence F. The stop 246 is a small extrusion (same as No. 44, U.S. Pat. No. 5,337,641) which fits in the T-slot 218 and has a tapped hole into which round head screw 248 is threaded. Washers 250 are provided beneath the head of screw 248 to abut against the end of the fence F, to establish the position of the track 200 relative to the fence F. When the L-shaped extrusion is properly positioned, the position stop is secured with the washers next to the end of the miter saw fence F as shown in FIG. 7, with the screw 248 being screwed down against the bottom of the T-slot 218.

Figure 8:
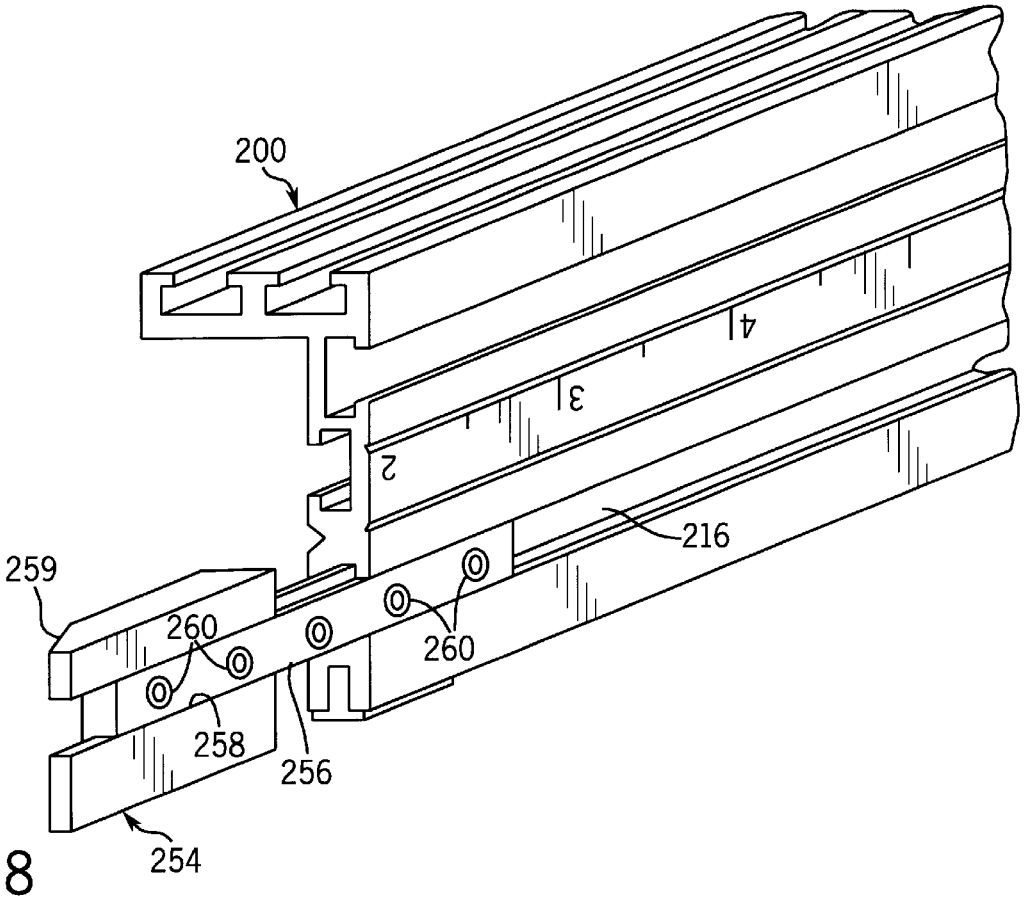
FIG. 8 is perspective view of an end cap for the track of FIG. 1.
Figure 24:
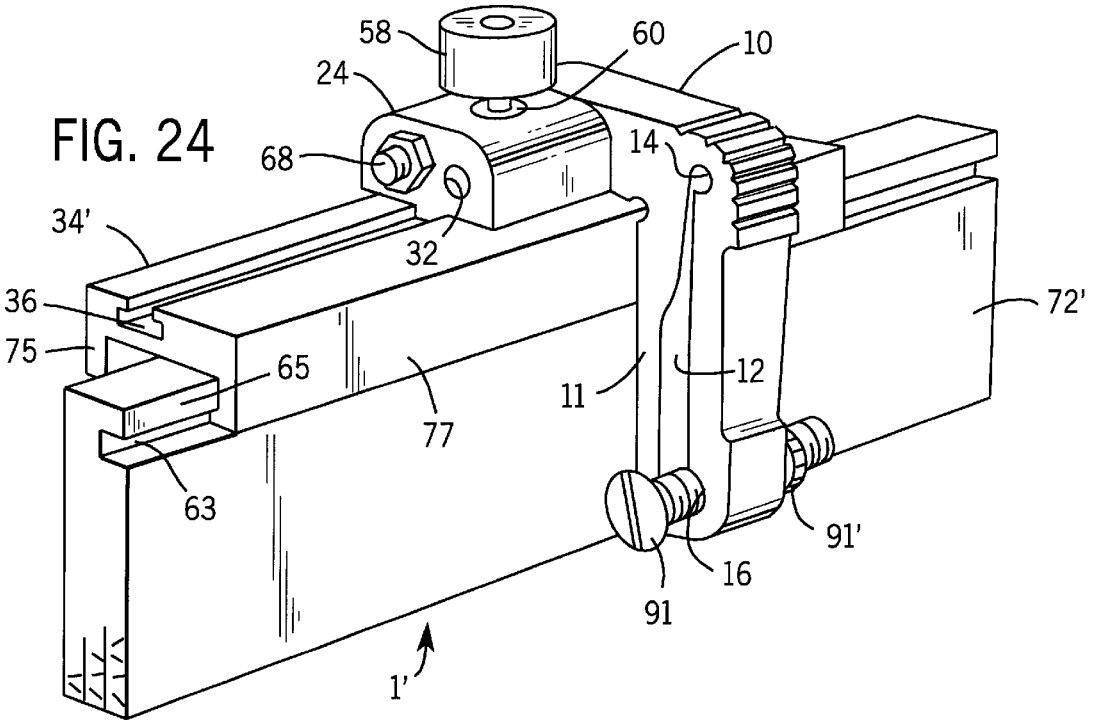
FIG. 24 is a perspective view of a wood fence and corresponding stop system which may be used to extend a track of the invention.

Referring to FIG. 8, when a wood fence is not used on the front of the track 200, an end cap 254 can be used which is designed to extend the L-shaped track 200 nearer to the tablesaw blade. Supporting the workpiece near the blade improves the quality of the cut by decreasing vibration. The cap 254 is also designed to easily fit under the saw blade guard, as shown in FIG. 24.

The cap 254 is secured to the lower T-slot 216 using a T-shaped connector 256 (same profile as No.44, U.S. Pat. No. 5,337,641) which slides inside the T-slot 216 and inside a similarly shaped T-slot 258 in the cap 254, which has a beveled end 259. Drilled and tapped holes in the connector 256 contain set screws 260 that bottom in the respective T-slots 216 and 258 to lock the end cap 254, connector 256 and track 200 together.

Figure 9:
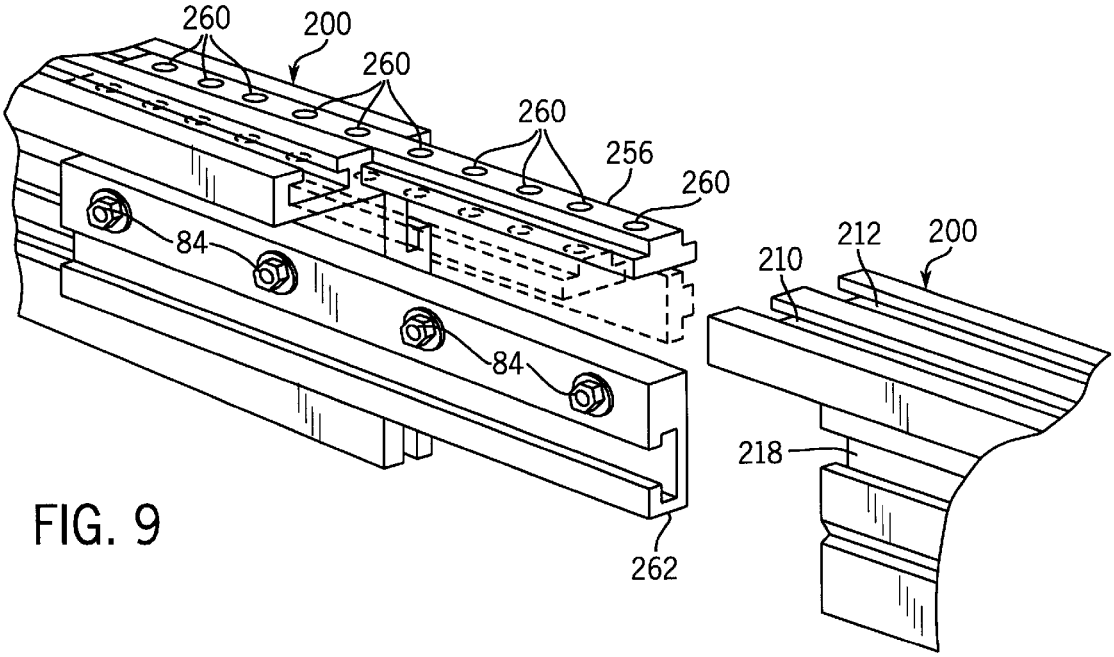
FIG. 9 is a perspective view of a connector set for two tracks of the type illustrated in FIG. 1.

Referring to FIG. 9, a connector set including a connector 256 and a larger profile connector 262 connects two sections of L-shaped track 200 together. The connector 256 fits inside any of the four T-slots 210, 212, 214 and 216 and is secured in place with set screws 260 tightened against each of the two pieces 200 by a 3/32 hex key. The other extrusion is an 8 inch piece of the track 34 dislosed in U.S. Pat. No. 5,337,641 with 4 holes and four nuts and bolts 84 for securing it to the back of the L-shaped track 200, with the heads of the bolts 84 being engaged in the T-slot 218. When the connector set is installed, it is as rigid as a solid extrusion. The connector set can be used to lengthen the track 200 on the tablesaw, miter saw, router table, drill press or any other place that the L-shaped track 200 is used.

Figure 11:
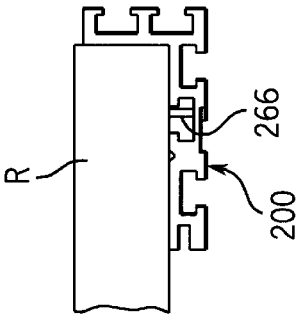
FIG. 11 is a detail plan view of a portion of FIG. 10.
Figure 10:
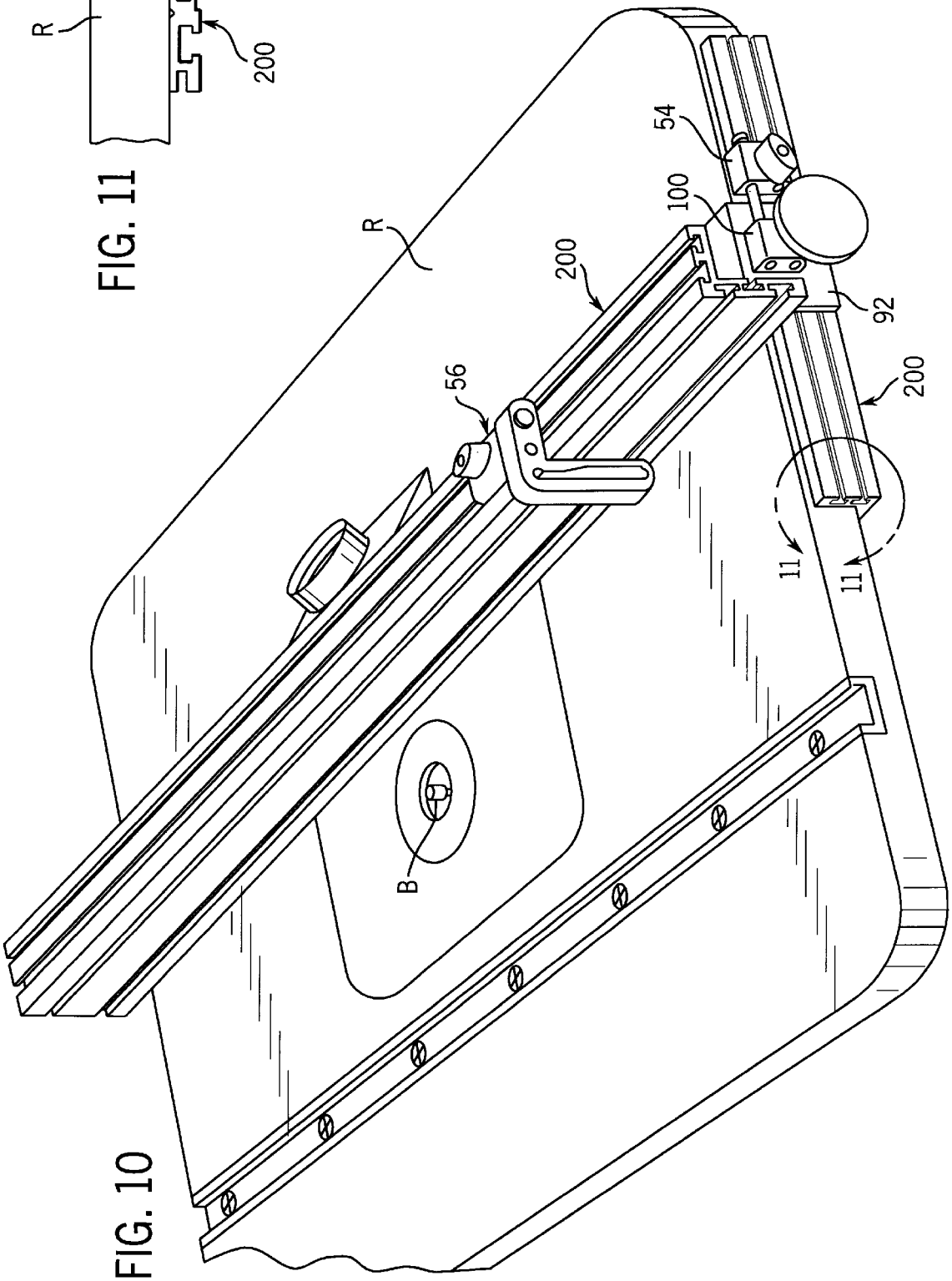
FIG. 10 is a perspective view of tracks of the invention applied to a router table.

An application of the L-shaped track 200 to a router table R is illustrated in FIGS. 10 and 11. The track 200 can be mounted to the bottom of a router table with screws 266 which allows the use of a microadjuster 54 and microbase 100 as described in U.S. Pat. No. 5,337,641 for fine adjustment of the router fence 200. Microbase 100 is attached to the T-slot 218 of track 200 using two angle brackets 92, only one of which is shown. The router fence 200 can be used with or without a wood auxiliary fence. Paper shims can easily be placed between the front 220 and one of two wood auxiliary fences (e.g., two fences 224 secured to the front 220 of the fence 200 end to end with the router bit B between them) to create an off-set fence for jointing operations or for complete profile cuts with the router bit B. The router table fence 200 may also be attached to the miter gauge and used for crosscutting or joinery operations such as dadoes, sliding dovetails, finger joints and dovetails.

Figure 13:
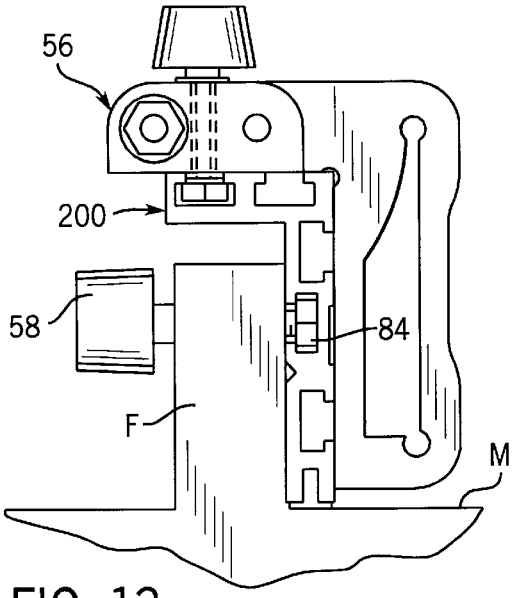
FIG. 13 is a detail end view of the track system of FIG. 12.
Figure 12:
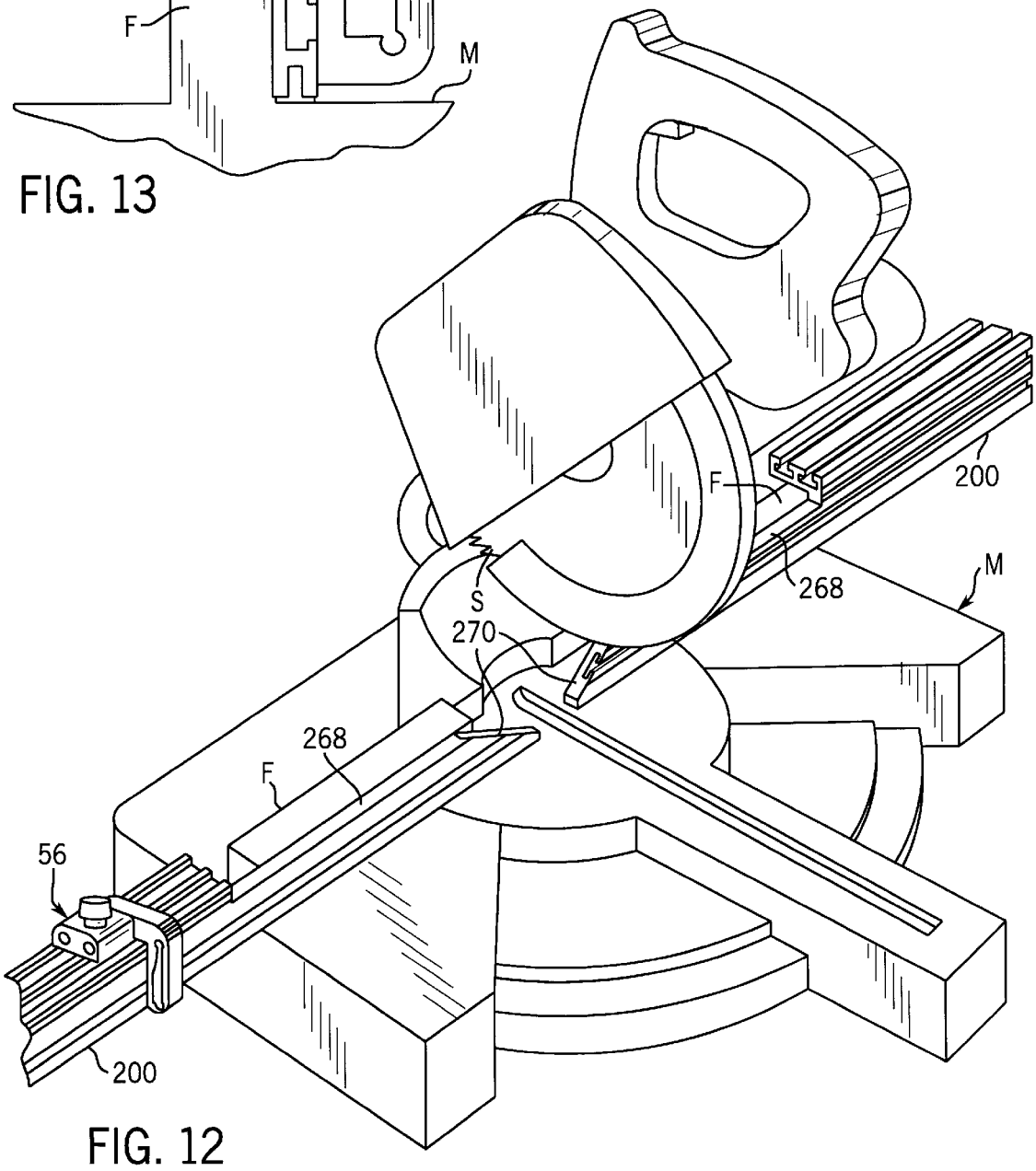
FIG. 12 is a perspective view of a system of the invention applied to a miter saw.

Referring to FIGS. 12 and 13, to insure that a track 200 can be applied to a miter saw M that will fit a wide variety of miter saws now available, cuts are made to remove portions of the extrusion 200. The top 222 of each track 200 near the blade S has been removed at 268 so that it will fit on a saw with a fence F, which is typically metal, higher than 2⅜". The inside corners 270 of the two tracks 200 near the blade S are cut off at a 45° angle so the blade S can be tilted either way for a compound cut.

On most miter saws, the system is attached to the fence F with four bolts, two for each side. Two 5/16" holes are drilled in the fence, 1½" up from the table as shown in FIG. 13. If the standard fence on the miter saw is less than 1½" high, 5 holes are provided in the front bottom slot 216 for attaching the track 200 to the standard fence F with self tapping stainless steel screws.

Figure 14:
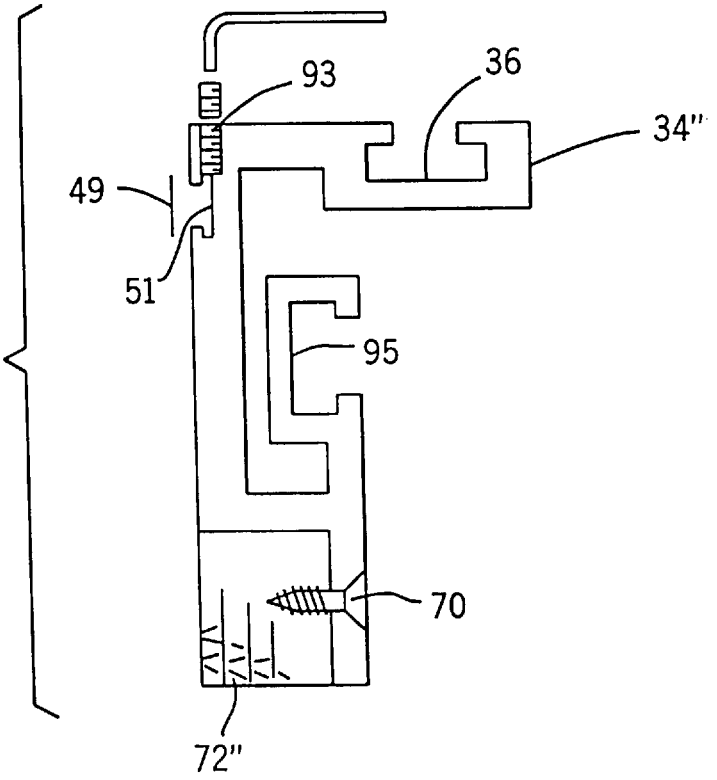
FIG. 14 is an end plan view of an alternate track of the invention with an auxiliary fence attached.
Figure 15:
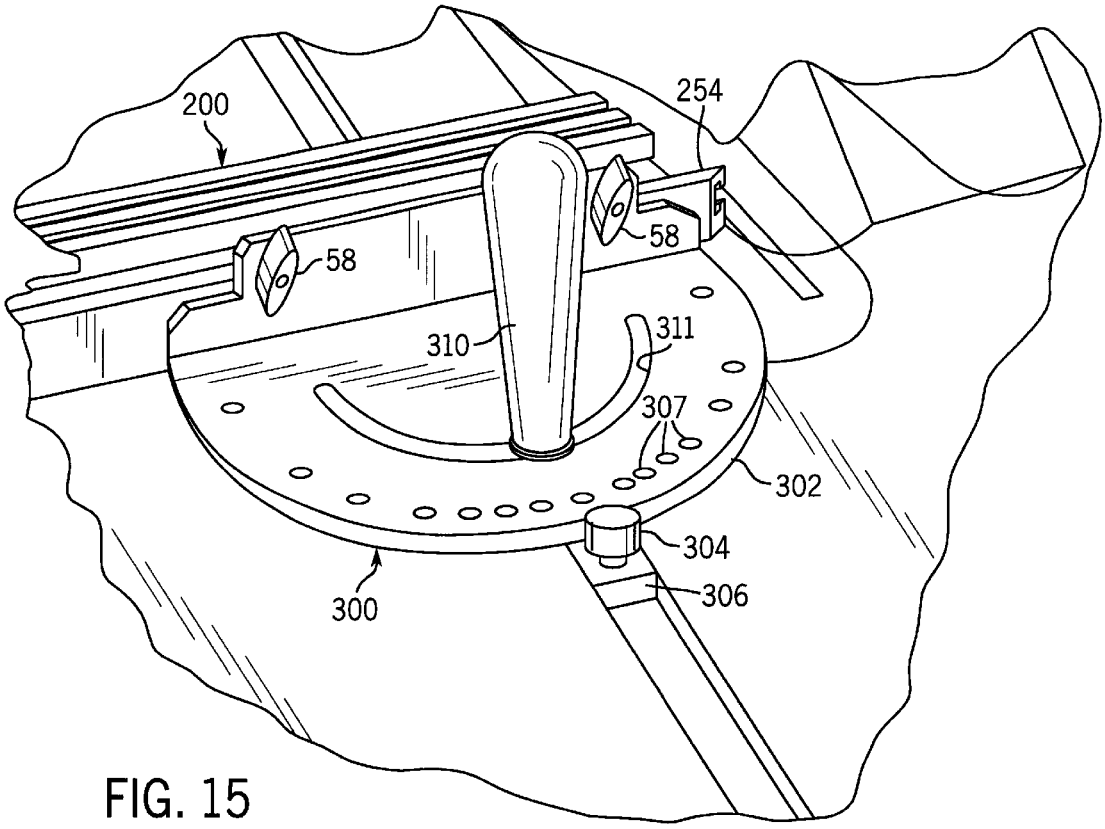
FIG. 15 is a rear perspective view of a specially adapted miter guide for mounting a system of the invention.
Figure 16:
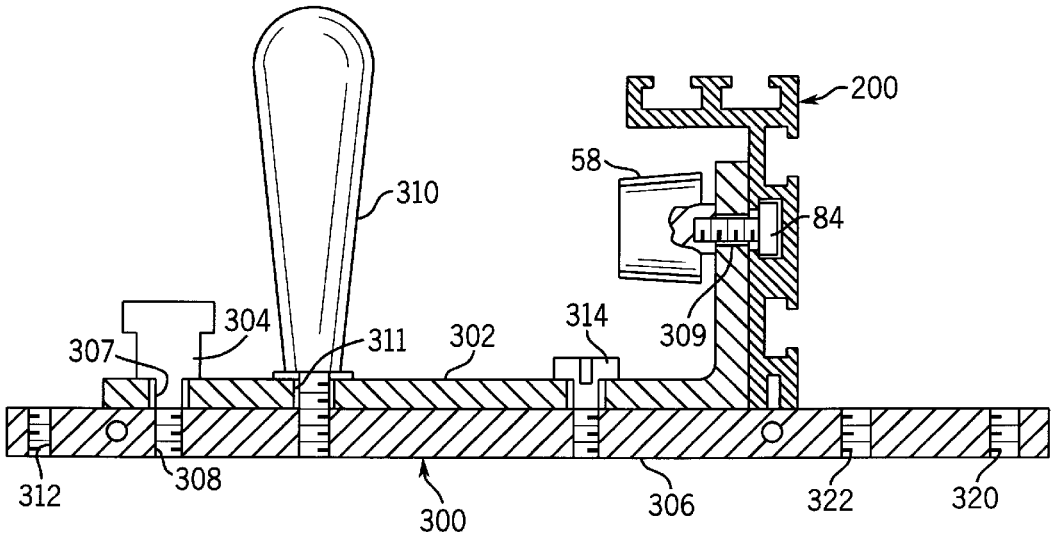
FIG. 16 is a partial cross-sectional view of the miter guide of FIG. 16.

FIG. 14 illustrates an alternative embodiment 200' of the invention for using a low wooden auxiliary fence (See FIG. 4 and related description above). The track 200' is a single aluminum L-shaped extrusion which is screwed to a relatively small auxiliary fence 72 by screws 70. The track 200' provides a single top slot 36 for mounting a flip stop 56, microadjuster 54, location stop 246, etc., a slot 51 for receiving a ruler 49 and a set screw hole 93 for receiving a set screw to secure the ruler in the slot 51. The track 200' also provides a second slot 95 similar to slot 218, which is used for mounting the track 34 to a work fixture, jig, fence or similar structure, so that the track 200' is slidable relative to the miter bar.

A track of the invention has particular application, as described above, in connection with a miter gauge and other jigs and fixtures. Accordingly, an aspect of the invention is a precision miter gauge 300 that has several unique features specially adapted for use with the track 200. As shown in FIGS. 15–19, it has the most common angle locations drilled and reamed in the head 302, so that those locations can be located very accurately. A thumbscrew 304 having a shank which is precision located in the reamed holes 307 (only some of which are labeled in FIG. 15) of head 302 screws into the miter bar 306 through a drilled and reamed hole 308 in the miter head 302 for a positive stop at 0° and plus or minus 10°, 15°, 22½0, 30°, 45°, and 60° angles. The locking handle 310 extends through slot 311 and is used to set angles that fall between the holes 307 provided using engraved degree markings (e.g., See FIG. 19) as a guide. A 1 threaded hole 312 is used to store the pin 304 when the locking handle 310 is used. The miter bar 306 is preferably a ⅜"×¾"×17" long steel bar with four miter bar bearings as described in connection with FIGS. 18 or 40 of U.S. patent application Ser. No. 08/278,369, incorporated above.

The head 302 measures 2" high×5¼" deep×7½" long and is ¼" thick. It is constructed of black anodized aluminum machined on CNC equipment for superior accuracy. There are two mounting holes 309 to make attachments to it, such as the track 34 of U.S. Pat. No. 5,337,641 or the new L-shaped track 200.

Figure 17:
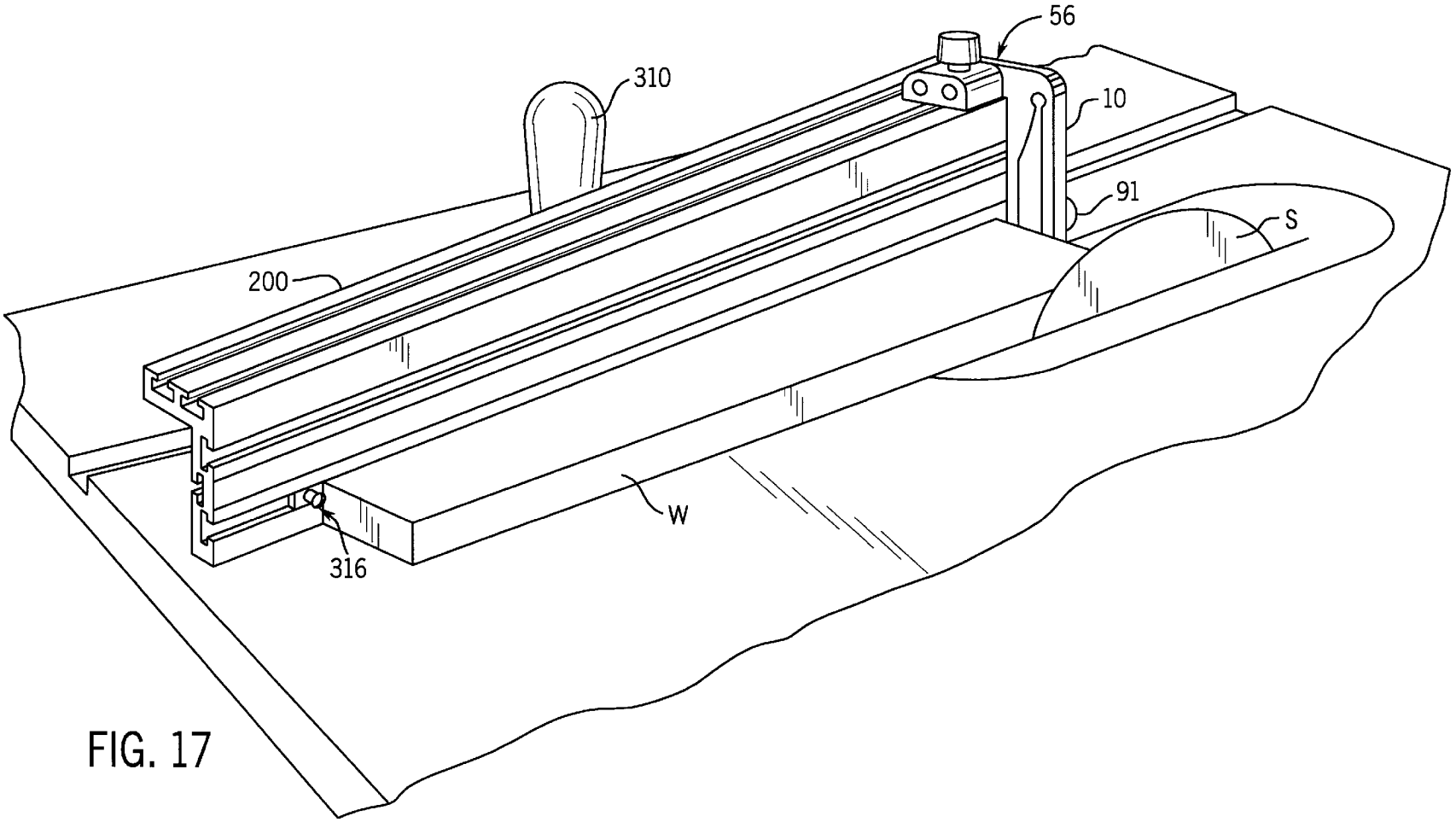
FIG. 17 is a perspective view of a system of the invention applied to a table saw for cutting tapers.
Figure 19:
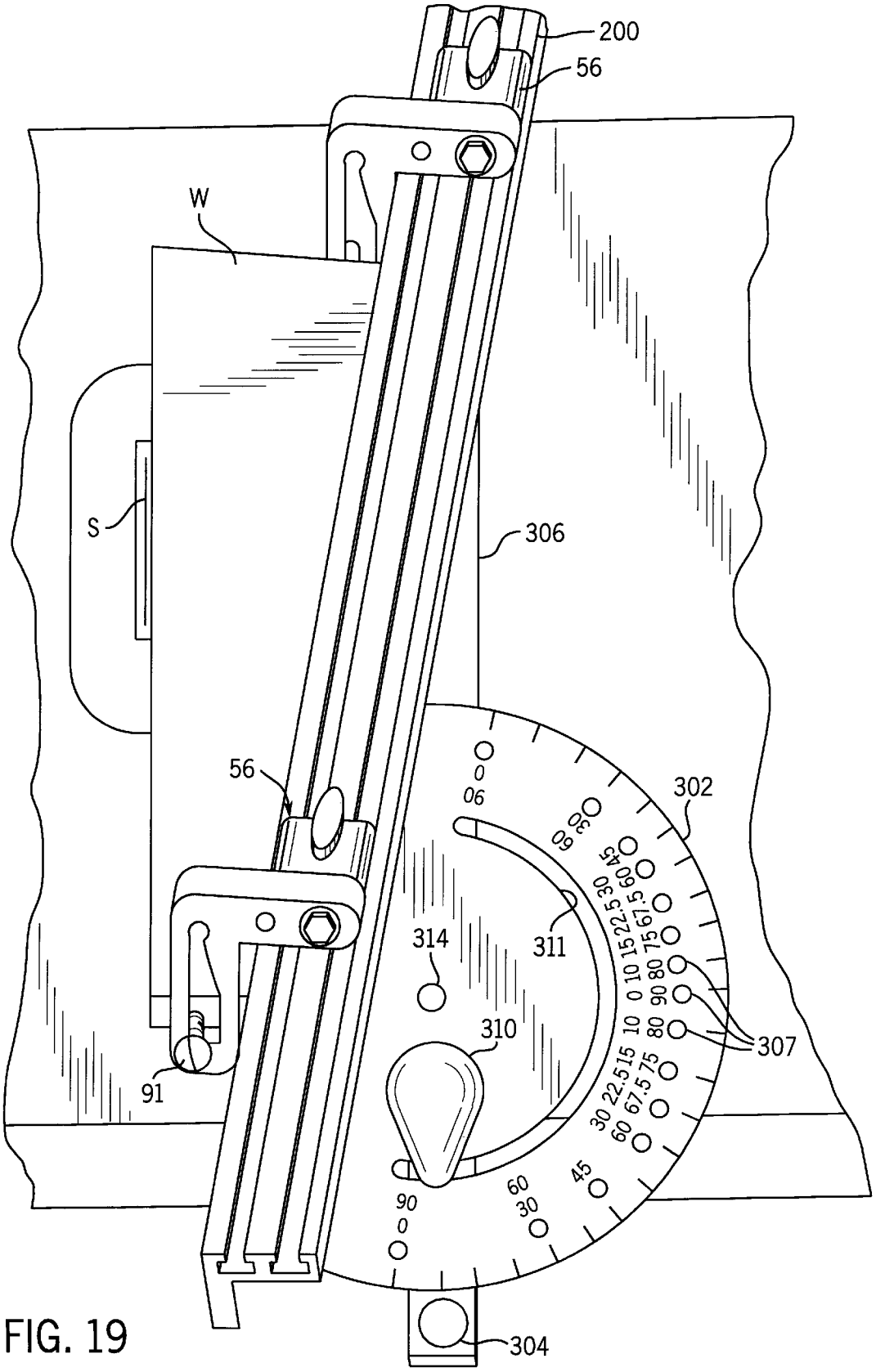
FIG. 19 is a top perspective view illustrating another setup of a system of the invention on a table saw for cutting tapers.

The miter head 302 turns a full plus or minus 90° (i.e., in each direction) from the 0° about pivot screw 314 which allows cutting tapers and similar long shallow angles, as shown in FIGS. 17 and 19. In fact, the head 302 may be turned through a range of plus or minus 180°, so that it can be reversed to a 180° position with its vertical working face 315 facing in the opposite direction from the normal 0° position shown in FIGS. 15 and 16. In the 180° position (and other standard positions between −90° to −180° and +90° to +180°), the head 302 is secured to the bar 306 by inserting thumbscrew 304 through the appropriate hole 307 and screwing it into threaded hole 320 in the bar 306. The handle 310 can also be screwed into hole 322 to secure any angle between the −90° to −180° and +90° to +180° positions.

Figure 18:
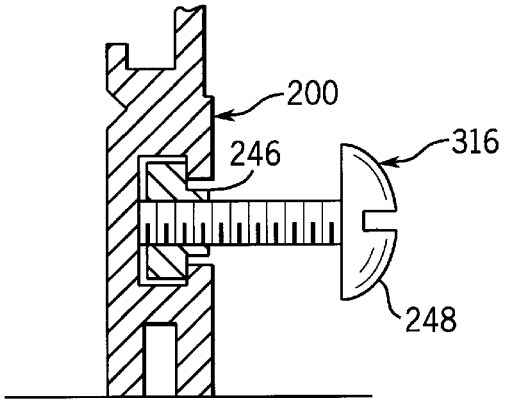
FIG. 18 is a detail cross-sectional view illustrating a stop shown in FIG. 17.

As shown in FIGS. 17 and 18, stop 316 (including location stop 246 and screw 248) can be used in conjunction with the L-shaped track 200 secured to the head 302 to guide a workpiece W while pushing the workpiece W into sawblade S when cutting a taper. A flip stop 56 is positioned at the opposite end of the workpiece W, and has a flat head microadjustment screw 91 threaded into the lower end of the stop 10 for bearing against the end of the workpiece W to clamp it against the stop 316. Alternatively, as shown in FIG. 19, two stops 56 may be used, with the workpiece W clamped between the two screws 91 of the stops 56.

Mouldings for standard 4, 6 and 8 sided frames (e.g., picture frames) require making all of the cuts on one end of the moulding from one side of the blade and the cuts on the opposite end of the moulding from the opposite side of the blade. This procedure normally requires resetting the miter head angle and fence for use in each miter slot on the opposite sides of the blade, which is time consuming.

Figure 20:
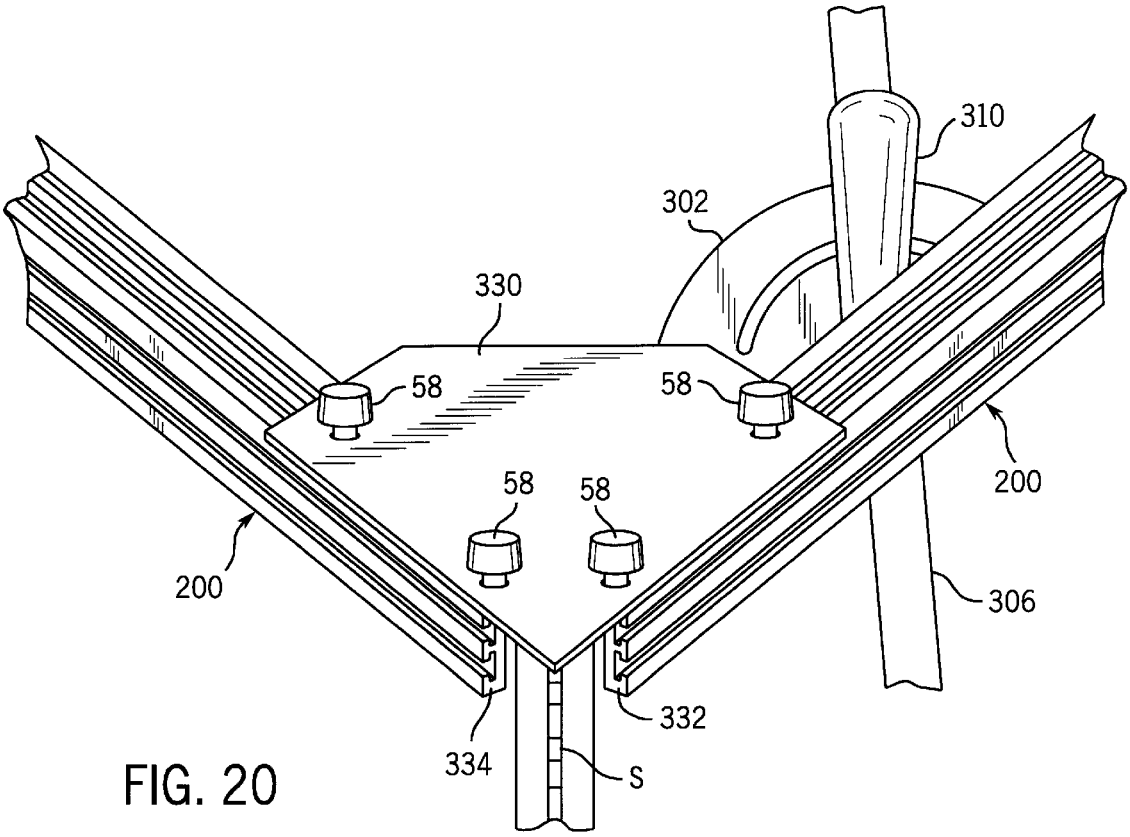
FIG. 20 is front top perspective view illustrating a system of the invention in which two tracks are connected together by an angle bracket and one of the tracks is fixed to a miter guide for cutting frame pieces.
Figure 21:
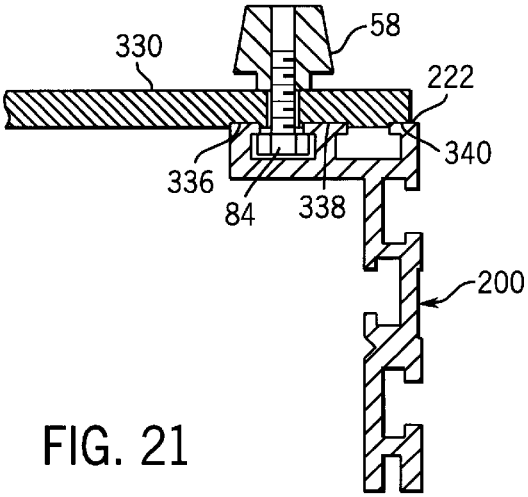
FIG. 21 is a detail cross-sectional view through the angle bracket and one of the sections of track shown in FIG. 20.

Instead, as shown in FIGS. 20 and 21, an angle connector 330 may be used to secure two pieces of L-shaped track 200 together at an angle. One of the tracks 200 is attached to the tablesaw miter head 302, and the unit is moved passed the blade S, with the blade S passing in the space between the inner ends 332 and 334 of the tracks 200. The advantage is that both ends of the moulding can be cut one after the other without changing the setup.

The angled connector 330 is made from ⅜" phenolic which is machined on a CNC milling machine for precision. Three grooves 336, 338, 340 are cut in the phenolic so that they receive the top 222 of the track 200, with the lands between the grooves 336, 338, 340 extending down into the T-slots 210, 212 to secure the angle of the track relative to the connector 330. The connector 330 can be secured to the L-shaped track with standard ¼-20 bolts 84 as shown in FIG. 21. A 90° connector (shown in FIG. 20) secures the two pieces of L-shaped track 200 together for 4 sided frames. 120° and 135° angled connectors (not shown) may also be made for making 6 and 8 sided frames.

Figure 22:
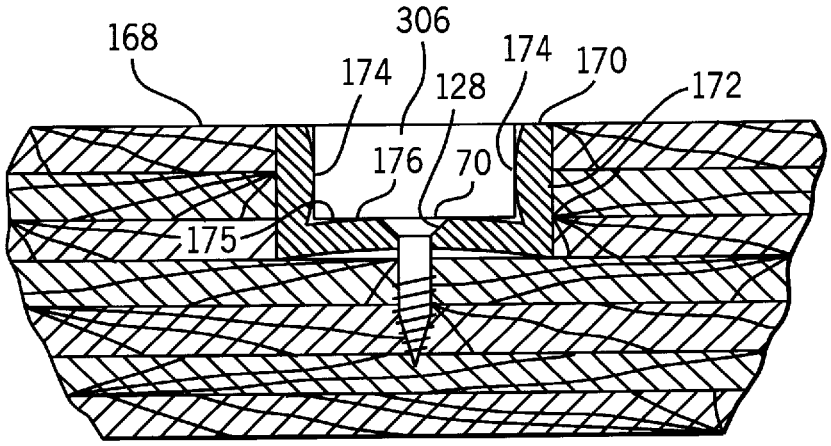
FIG. 22 is a detail cross-sectional view of a miter bar channel guide for practicing the invention.

An adjustable U-shaped channel 170 (FIG. 22) may be used in a wood table top to guide the miter bar 306 therein (See also U.S. Pat. No. 5,337,641 and U.S. patent application Ser. No. 08/278,369, incorporated above). The channel 170 is preferably made of a relatively hard but flexible material such as extruded aluminum, but could also be made of other materials having the required hardness and flexibility, such as steel or perhaps some plastics, and is made to suitable lengths so as to fit standard sizes of auxiliary wood table tops. The inside of the U-shaped channel 170 is slightly larger than the ⅜" by ¾" miter gauge bar 306. The adjustable U-shaped channel 170 fits into the dado cut 172 in the wood table 168 and is attached to the table 168 with a drywall screw 70 inserted through a chamfered hole 128 in the bottom wall 175 of the channel 176 as shown in FIG. 22. The bottom wall 175 is arced so as to be convex away from the direction of the insertion of screw 70 (toward the top), and the inner surfaces 174 of the sidewalls of the channel 176 are bowed inwardly so as to be convex toward one another. The exterior surfaces of the sidewalls of the channel 176 may be flat.

As the screw 70 is advanced into the table 168, the bottom of the U-shaped channel 176 flexes downwardly so as to flatten slightly and the inside walls 174 move toward each other as a result, allowing an adjustable fit between the inside of the U-shaped channel 170 and the miter gauge bar 306. By adjusting the fit between the inside of the U-shaped channel 170 and the miter gauge bar 306, sloppiness between the bar 306 and the channel 176 can be eliminated thereby improving the accuracy of the workpiece, jig and or fixture setup.

Figure 23:
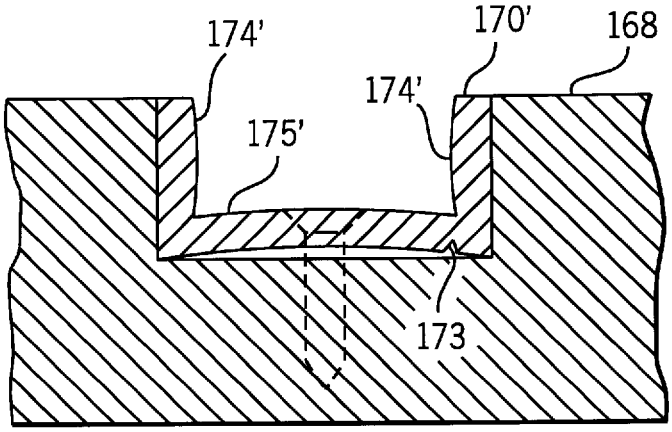
FIG. 23 is a view similar to FIG. 22 illustrating an alternate embodiment.

An alternative channel 170' as shown in FIG. 23 is the same as the channel 170 except that it has the lower portion of the left (as shown in FIG. 23) interior surface 174' flat and has a longitudinally running V-shaped notch 173 in the exterior surface of its bottom wall 175' adjacent to the right (as shown in FIG. 23) surface 174'. The notch 173 causes most of the inward bending of the sidewalls to be performed by the right sidewall (as shown in FIG. 23), and causes that bending to be more uniform over the length of the right sidewall. The flat lower portion of the left surface 174' provides a flat surface for the bearings in the miter bar 306 to bear against, so that as the bearings 130 slide along the flat side as the miter bar is slid in the channel 170', the bearings do so exerting uniform pressure against that side, even though the right sidewall of the channel 170' may not be uniformly bent in over its length, but may be somewhat "wavy" over its length.

Figure 25:
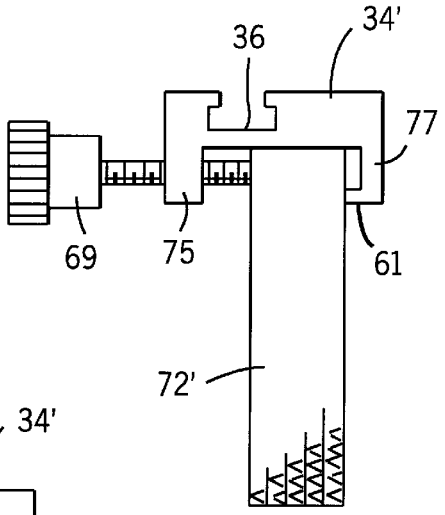
FIG. 25 is an end view of the stop system of FIG. 25 mounted to a wooden fence like the auxiliary fence of FIG. 2.

FIG. 25 illustrates a jig and fixture system, described in U.S. patent application Ser. No. 08/278,369, incorporated above, which may be used to extend the track 200, by securing the auxiliary wood fence 72' to the front of the track 200, just like the fence 224 is secured to the front 220, and extending the fence 72' past the end of the track 200. The fence 72' could alternatively be secured to the T-slot 218 in the back of track 200, with the front of fence 72' against the rear 225 of the track 200 for the overlapping length of the track 200 and the fence 72'.

As illustrated in FIGS. 24–29, the track 34', which is also preferably an aluminum extrusion, has a slot 36, and the base 24 is slidably secured in the slot 36 in the same manner described above. However, the attachment of the track 34' to the fence 72' differs in that the track 34' is secured to the fence 72' by a thumb screw 69 which is threaded through flange 75 of the track 34'. A flange 77 extends down from the main portion of the track 34' on the other side to form a slot on the underside of the track 34' between the flanges 75 and 77, in which the top of the auxiliary fence 72' is received. The flange 79 has an inward extension 61 which forms an undercut shoulder above it.

The auxiliary fence 72' can be a rectangular board having flat sides as shown in FIG. 25, in which case it would be the same as the fence 224. If the fence 72' is as shown in FIG. 25, then flange 79 bears against the front flat face of the fence 72' and the inner end of the thumb screw 69 bears against the opposite face of the fence 72' to clamp the track 34' to the fence 72'. With this attachment, the screw 69 can be loosened and the track 34' slid along the top of the fence 72' or lifted therefrom and replaced on it, to change the position of the track 34' on the fence 72'.

Figure 26:
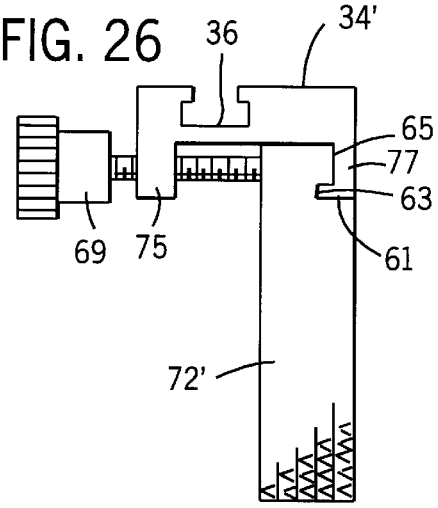
FIG. 26 is a view similar to FIG. 25 but showing the stop system mounted to a wood fence as illustrated in FIG. 24.
Figure 27:
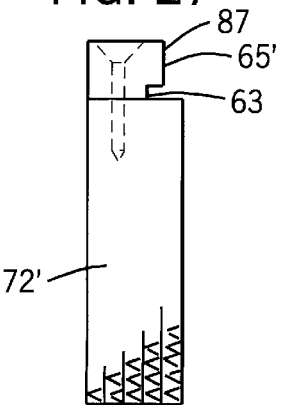
FIG. 27 is an end view of an alternate fence which could be used with the stop system of FIG. 24.
Figure 28:
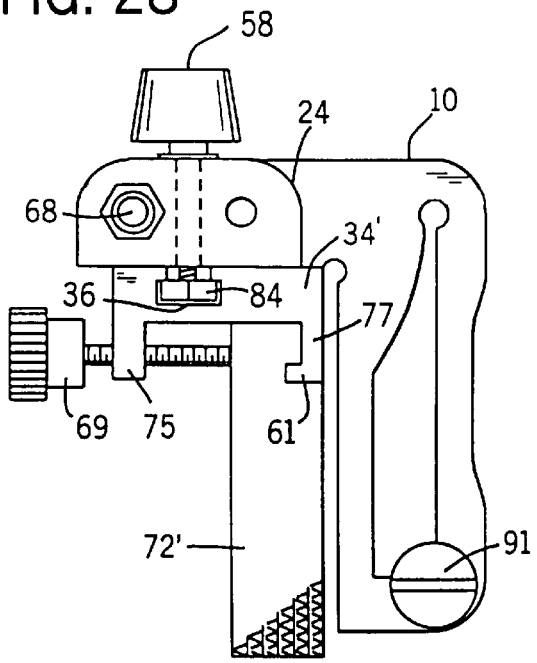
FIG. 28 is an end view of the system of FIG. 24.
Figure 29:
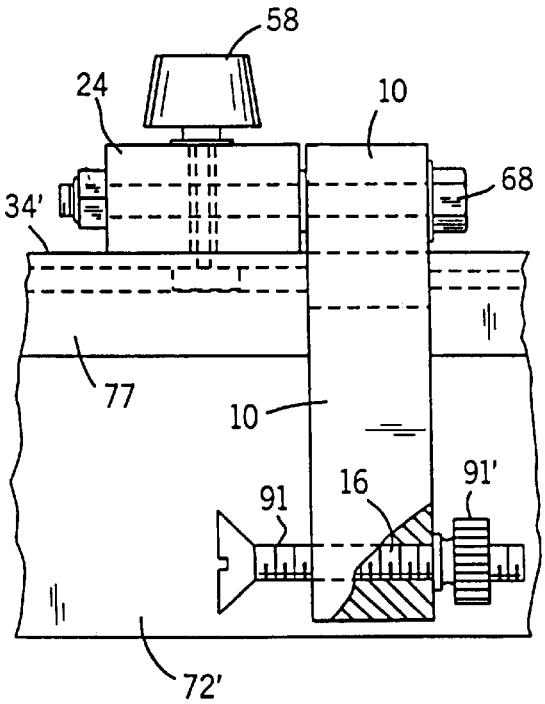
FIG. 29 is a front view of the system of FIG. 24.

Preferably, the auxiliary fence 72' is the shape shown in FIGS. 24 and 26, so as to provide a groove 63 and recessed surface 65 to receive the L-shaped flange 79, with the extension 61 received in the groove 63, and the front face of the track 34' flush with the front face of the fence 72'. This construction facilitates sliding of the track 34' along the top of the fence 72' without unduly stressing the wood of the fence 72', since it is subjected to mainly compressive forces and not shear forces. Also, the track 34' can still be lifted off of the fence 72' without sliding it all the way to the end of the fence 72', by simply backing out the screw 69 far enough so that the extension 61 can be withdrawn from the groove 63 and clear the surface 65.

The surface 65 and groove 63 can be formed in an auxiliary fence 72' like that shown in FIG. 25 by making two ⅛" saw cuts (or router cuts) at 90° to one another, one to form surface 65 and the other to form groove 63. Making such cuts can be avoided with an aluminum extrusion 87 having the cross-sectional shape shown in FIG. 27, which defines groove 63' and surface 65', and is screwed to the top of a wooden board which together with the extrusion 87 makes the auxiliary fence 72'.

Figure 30:
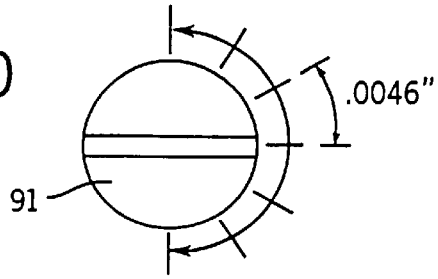
FIG. 30 is a schematic view of the head of the stop bolt of the system of FIG. 24.

Referring particularly to FIGS. 24 and 28–30, in the stop 10 shown in these figures the hole 16 is threaded to engage a flat head bolt 91 just like bolt 91 in FIG. 19. A threaded brass thumb-nut 91' is received by the screw and acts as a locknut, to maintain the setting of the bolt 91 when it is tightened against the stop 10. With a 5/16 inch standard bolt, 1/12 of a revolution results in the head of the bolt 91, which abuts the workpiece to act as the stop, moving 0.0046", as depicted in FIG. 30. Woodworkers oftentimes like to use measurements of roughly four thousandths of an inch, so by using the division of 12 similar to the divisions on a clock, a woodworker can calibrate a fine adjustment. Thus, the bolt 91 provides a form of microadjust feature to the system 1'. It should also be understood that, if desired, a microadjuster 54 could be employed in the system 1' to make fine adjustments of the base 24.

Figure 31:
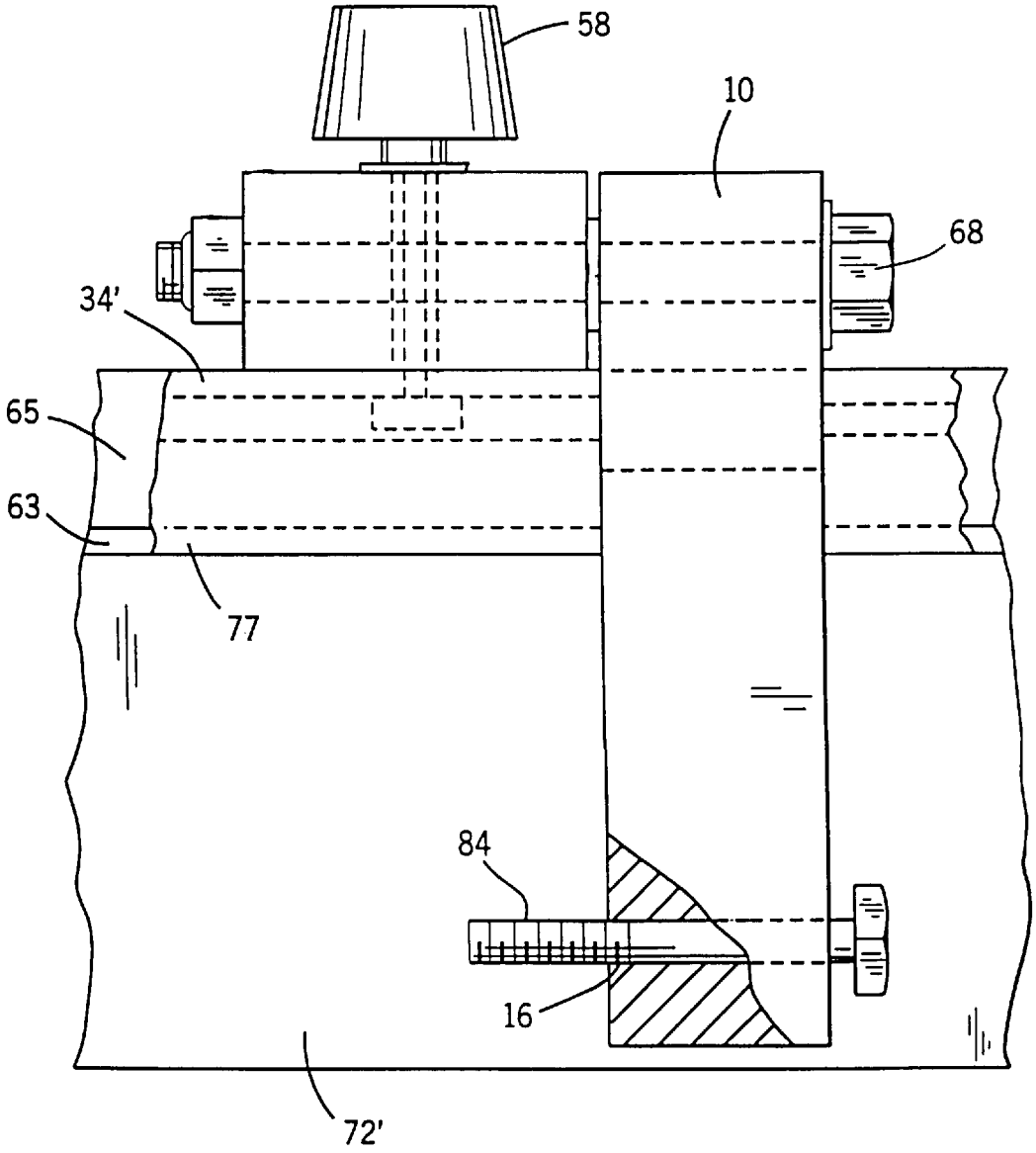
FIG. 31 is a view similar to FIG. 29 but showing an alternate bolt.
Figure 32:
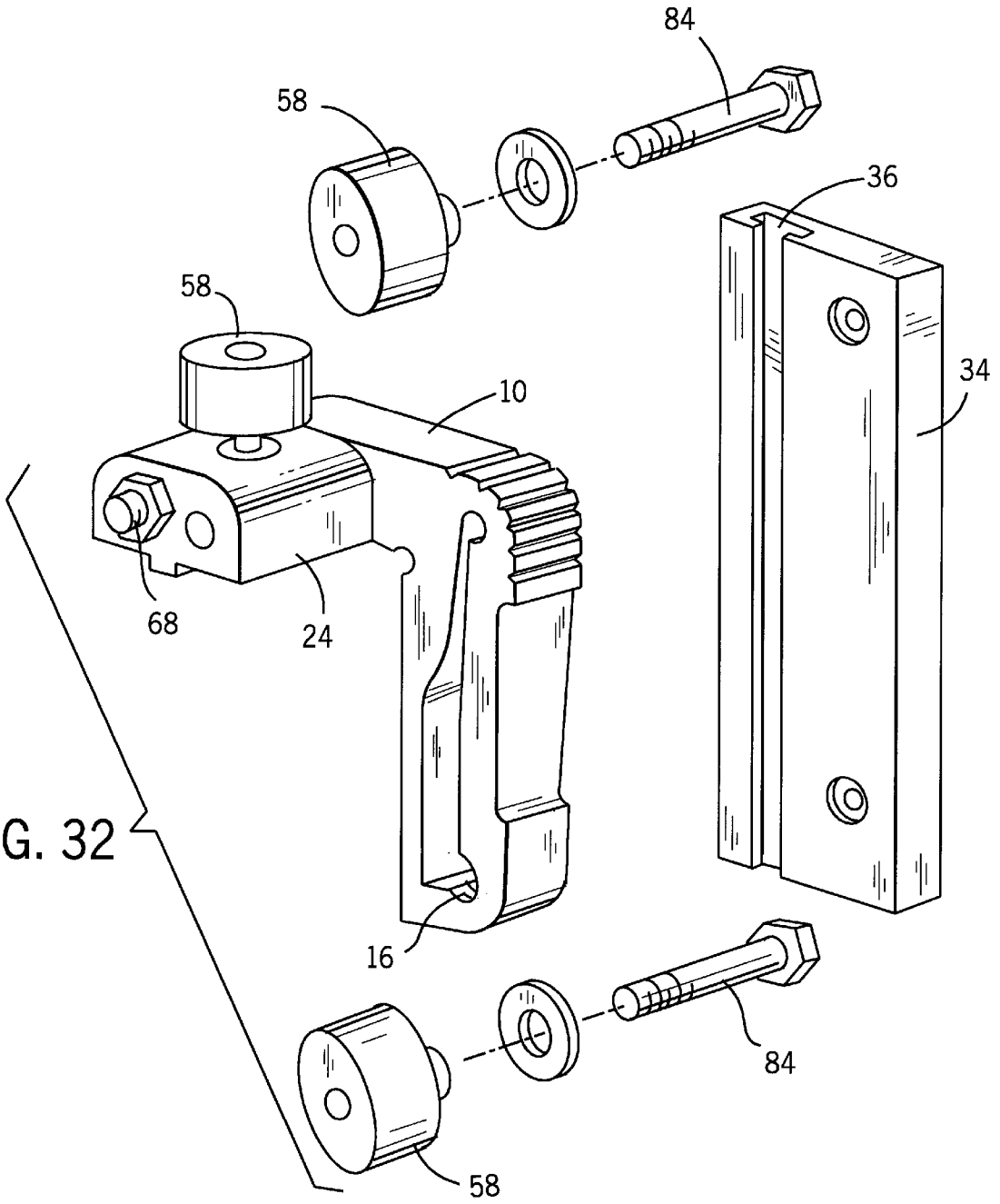
FIG. 32 is an exploded perspective view illustrating how the system can be used with the bolt of FIG. 31.

FIGS. 31 and 32 illustrate a ¼" bolt 84 through the 5/16" threaded hole 16 to illustrate how the hole 16 can still be used to mount a section of track 34 having T-slot 36 or a fence, as discussed in connection with FIGS. 8 and 10 of U.S. patent application Ser. No. 08/278,369, incorporated above. Since the ¼" bolt 84 is sufficiently smaller than the 5/16" threaded hole, the ¼" bolt 84 can turn in the hole 16 without significant interference.

A woodworking machinery jig and fixture system incorporating the invention has been described above in considerable detail. Modifications and variations will be apparent to those in the art which will still incorporate the invention. Therefore, the invention should not be limited to the scope of the foregoing description, but should be defined by the claims which follow.

I claim:

1. In a woodworking machinery jig and fixture system of the type having a section of track along which jigs and fixtures may be adjustably secured, the improvement wherein said track has a generally L-shaped cross-sectional shape, having a first leg with a front side and a rear side and a second leg connected to one end of said first leg at a right angle, said second leg extending rearwardly from said first leg and having a top side and a bottom side, said track having with a longitudinal T-slot on said rear side of said first leg and a longitudinal T-slot on a top side of said second leg.

2. A system as claimed in claim 1, wherein a second longitudinal T-slot is formed in said top side of said second leg.

3. A system as claimed in claim 1, wherein a longitudinal T-slot is formed in said front side of said first leg.

4. A system as claimed in claim 2, wherein a second longitudinal T-slot is formed in said front side of said first leg.

5. A system as claimed in claim 1, wherein a wood fence is secured to said track against said front side of said first leg.

6. A system as claimed in claim 5, wherein said wood fence is one piece and extends from top to bottom over substantially the entire height of said front side of said first leg.

7. A system as claimed in claim 5, wherein said wood fence has an upper longitudinal piece and a lower longitudinal piece.

8. A system as claimed in claim 1, wherein said track is secured to a miter head by a fastener which clamps against flanges of said T-slot in said rear side of said first leg.

9. A system as claimed in claim 8, wherein said miter head is adjustable through at least plus or minus 90° from a 0° position.

10. A system as claimed in claim 9, further comprising means for adjusting said miter head in angular positions in the ranges of plus 90° to plus 180° and minus 90° to minus 180° degrees.

11. A system as claimed in claim 8, further comprising stops secured to said track which clamp a workpiece between them to hold said workpiece against said front surface of said first leg.

12. A system as claimed in claim 11, wherein said stops include at least one flip stop.

13. A system as claimed in claim 1, further comprising an end cap secured to said first leg of said track at an end of said first leg for supporting a workpiece closely adjacent to a cutting tool.

14. A system as claimed in claim 13, wherein said end cap is of a lower height than said first leg.

15. A system as claimed in claim 1, wherein two of said tracks are connected end to end.

16. A system as claimed in claim 1, wherein two of said tracks are connected at a certain angle by an angle bracket and with a space between them.

17. A system as claimed in claim 16, wherein one of said tracks is secured to a miter head.

18. A system as claimed in claim 1, wherein a wood fence is secured to said track against said front face of said first leg and a stop is adjustably positionable along a top edge of said wood fence.

19. A system as claimed in claim 1, wherein said track is secured to a metal fence of a woodworking machine.

20. A system as claimed in claim 1, wherein said track is secured to a miter head which is secured to a miter bar, and said miter bar is slidable in an elongated longitudinal flexible channel having a generally U-shaped lateral cross-section with a bottom wall, two laterally spaced apart side walls and an open top, said side walls extending toward the top along opposite edges of said bottom wall, a lower surface of said bottom wall being raised in a lateral center thereof relative to side edges of said lower surface, said bottom wall having at least one hole therethrough for insertion of a threaded fastener to secure said guideway to a woodworking machinery support so that as said fastener is tightened said bottom wall is flexed downwardly and reduces a lateral spacing between said side walls.

21. A woodworking machinery guideway as in claim 20, wherein said bottom wall is convex toward said top in lateral cross-section.

22. A woodworking machinery guideway as in claim 21, wherein an inner surface of at least one of said side walls is arcuate in cross-section from top to bottom.

23. A woodworking machinery guideway as in claim 21, wherein a longitudinal notch is formed in the exterior surface of said bottom wall adjacent to one of said side walls.

24. A woodworking machinery guideway as in claim 21, wherein at least a portion of the interior surface of at least one of said side walls is flat.

* * * * *